United States Patent [19]

Batson

[11] Patent Number: 5,069,409

[45] Date of Patent: Dec. 3, 1991

[54] BOOK HOLDER

[76] Inventor: Jay D. Batson, 4727 E. Warner Rd., No. 1064, Phoenix, Ariz. 85044

[21] Appl. No.: 656,878

[22] Filed: Feb. 19, 1991

[51] Int. Cl.[5] ..... A47B 19/00

[52] U.S. Cl. ..... 248/451

[58] Field of Search ..... 248/441.1, 444, 451, 248/452, 453; 281/45, 46, 47

[56] References Cited

U.S. PATENT DOCUMENTS

| | | | |
|---|---|---|---|
| 571,254 | 11/1896 | Whitmore | 248/453 |
| 738,473 | 9/1903 | Neumann . | |
| 825,072 | 7/1906 | Power et al. . | |
| 2,136,701 | 11/1938 | Manierre . | |
| 2,284,501 | 5/1942 | Welch | 248/444 X |
| 2,402,903 | 6/1946 | Swearngin . | |
| 2,609,636 | 9/1952 | Stone . | |
| 2,661,569 | 12/1953 | Bargen . | |
| 4,145,022 | 3/1979 | Comfort | 248/451 X |
| 4,620,687 | 11/1986 | Bishop | 248/451 X |
| 4,681,291 | 7/1987 | Holladay | 248/451 X |
| 4,712,760 | 12/1987 | Winter | 248/451 |
| 4,894,756 | 1/1990 | Jan | 248/441.1 X |

FOREIGN PATENT DOCUMENTS

| | | | |
|---|---|---|---|
| 0104286 | 4/1924 | Switzerland | 248/444 |

*Primary Examiner*—Ramon O. Ramirez
*Attorney, Agent, or Firm*—Warren F. B. Lindsley

[57] ABSTRACT

A hand held book holder comprising an elongated trough like frame for supporting the open pages of a book and having an elongated handle extending axially therefrom. A rod is arranged to extend longitudinally of the frame for engaging the book along its binding to hold it in the trough with one end of the rod being detachably connected to the free end of the trough and the other end of the rod attached to the handle. A pressure plate is mounted on the handle to engage and hold a common edge of the open pages of the book and is biased into the pages by the other end of the rod and/or a suitable spring means.

10 Claims, 4 Drawing Sheets

BOOK HOLDER

BACKGROUND OF THE INVENTION

This invention relates to book holders and more particularly to a device having a handle for holding books with one hand in open and readable arrangement in various sitting or reclining positions. The novel device keeps the reader's place in the book without obscuring his view of the printed matter.

DESCRIPTION OF THE PRIOR ART

Although a number of patents exist in the art relating to book holders, none are known which anticipate the claimed subject matter.

U.S. Pat. No. 571,254 discloses a book holder comprising a frame with bearing members for the back and front of the book and terminating at its lower end in a handle.

U.S. Pat. No. 738,473 discloses a music rack having a back member which cooperates with a plurality of spring biased fingers.

U.S. Pat. No. 825,072 discloses a book holder which holds the cover of the book in an open book position while its leaves may be turned over.

U.S. Pat. No. 2,136,701 discloses a book holder employing clamping means for its cover without engaging its pages which are free for turning movement.

U.S. Pat. No. 2,402,903 discloses a suspended book rack for holding open a receipt book for convenient perusal.

U.S. Pat. No. 2,609,636 discloses a stand for supporting a book in an angular position employing a pressure plate for holding the book in an open position.

U.S. Pat. No. 2,661,569 discloses a book holder for holding a book at any point or angle about the upper flat surface of the holder.

U.S. Pat. No. 4,620,687 discloses a book holder employing pegs and stays for holding the pages of a book in open position.

SUMMARY OF THE INVENTION

In accordance with the invention claimed, a new and improved simple book holder is provided which may be held with one hand for ease and convenience in use.

It is, therefore, one object of this invention to provide a new and improved hand held book holder.

Another object of this invention is to provide a hand held base member for supporting a book in open page arrangement employing in combination a novel spring biased clamping member and a securing rod member which cooperate with the base to support an open book relative thereto.

A further object of this invention is to provide a hand held book holder that is attractive in appearance, strong and reliable in use and small and compact in structure.

A still further object of this invention is to provide a hand held book holder for ease of use in open book perusal employing a see through page clamp which renders the full exposed page readable and can be operated by the thumb of the hand holding the book holder.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
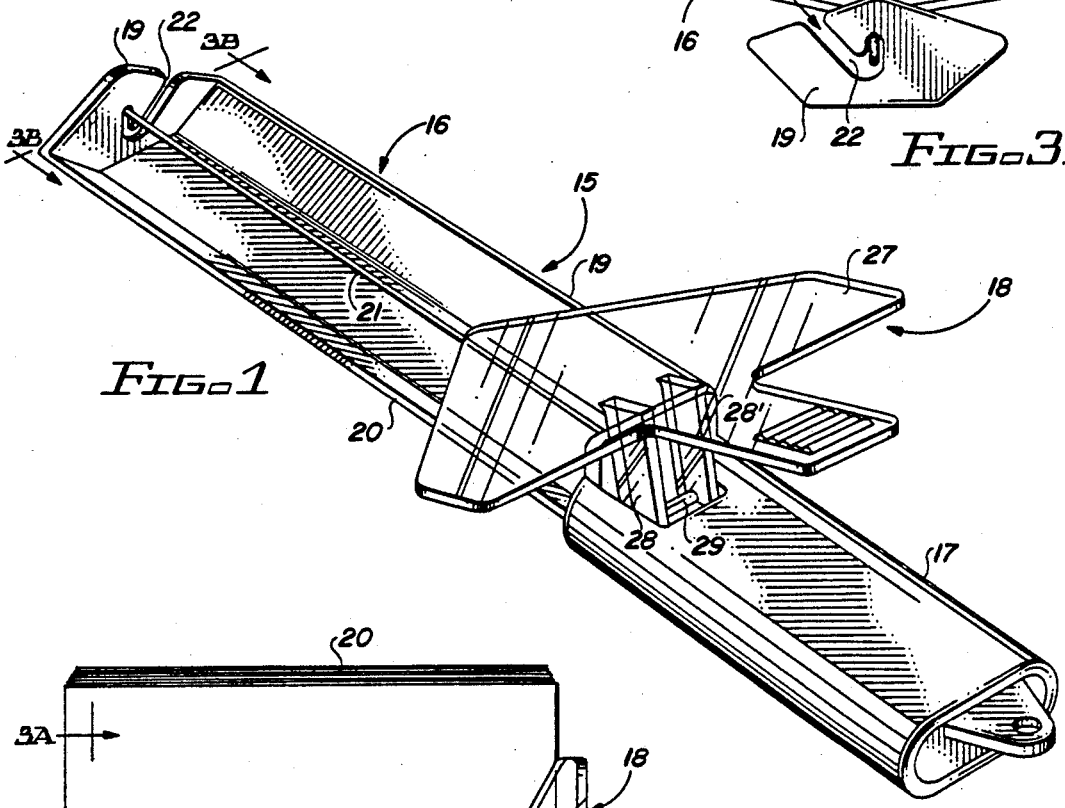
FIG. 1 is a perspective view of a hand held book holder and employing the invention.

Referring more particularly to the drawings by characters of reference, FIGS. 1-7 disclose a hand held book holder 15 comprising a substantially rectangular trough like base member 16, handle 17 axially aligned therewith at one end thereof, and a pressure means comprising a spring biased plate or clamp 18 mounted above handle 17 and extending over base member 16. The open end of the trough of base member 16 is closed by a slotted end member 19.

Base member 16 comprises a shallow trough that may be molded into a monolithic member with handle 17, as shown, or formed of individual base and side members glued together and still fall within the scope of this invention. Handle 17 may be wrapped with an elastic material as shown in FIGS. 1-11 for ease in using the book holder.

Figure 3B:
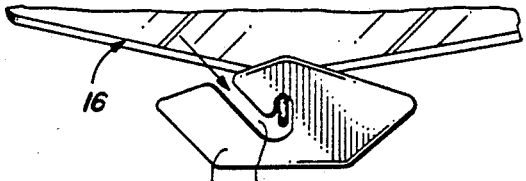
FIG. 3B is a cross sectional view of FIG. 1 taken along the line 3B—3B.
Figure 2:
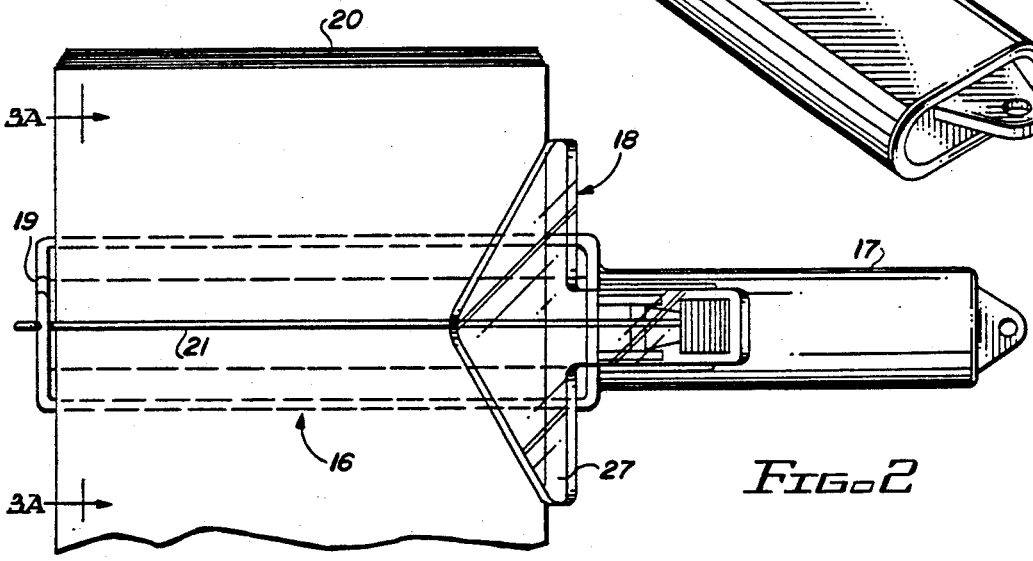
FIG. 2 is a top view of FIG. 1 with an open book in place.
Figure 3A:
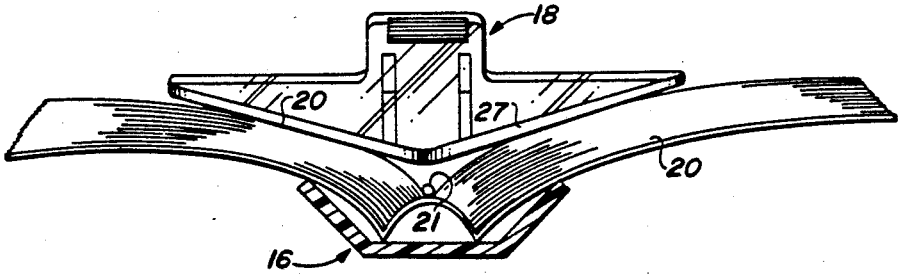
FIG. 3A is a cross sectional view of FIG. 2 taken along the line 3A—3A.

As shown in FIGS. 2 and 3A, a book 20 which, for example, may comprise a paper back book is placed cover down in the trough in open book position and held therein by a wire of clamping means 18.

Figures 4, 5, 6, 7:
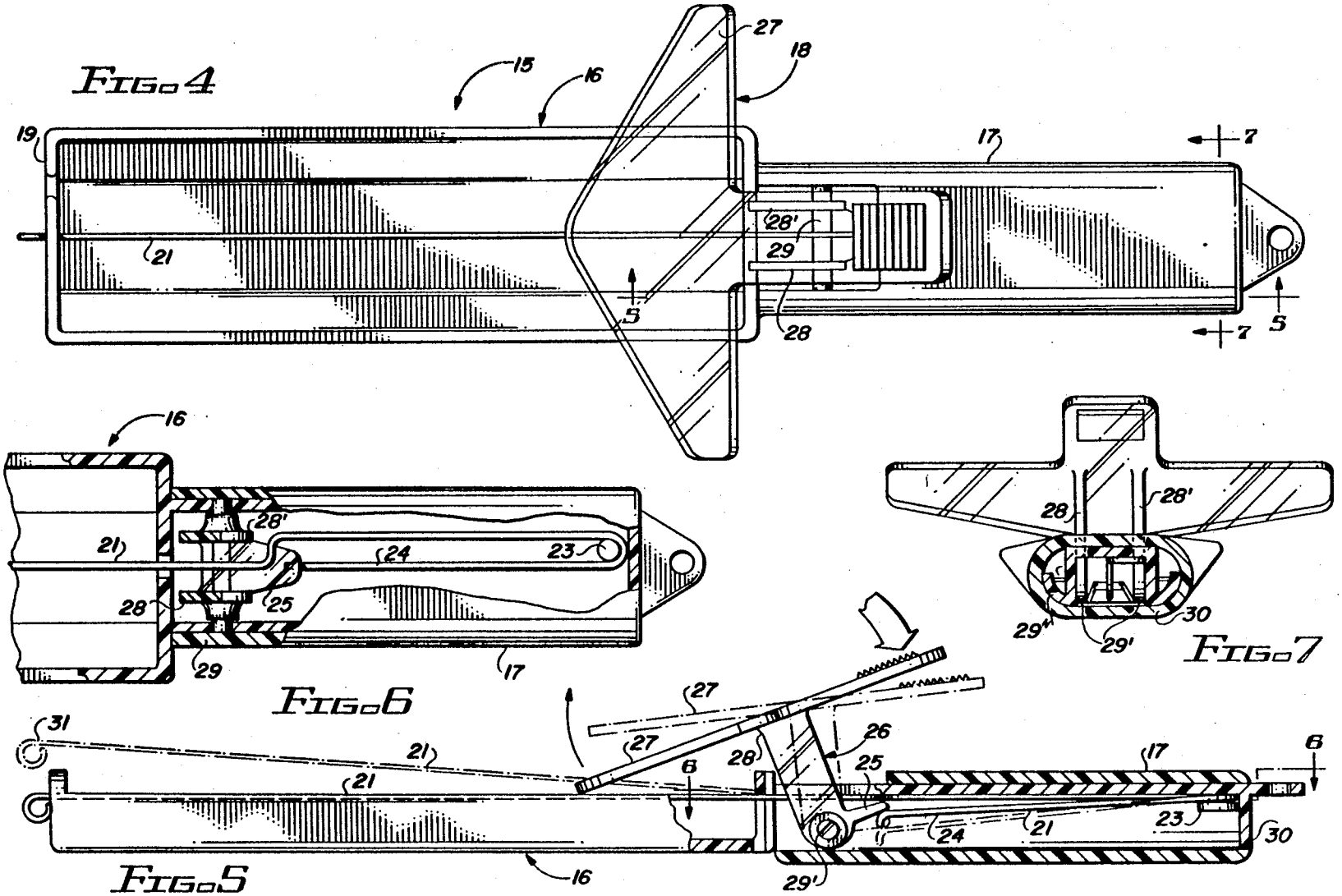
FIG. 4 is a top view of the hand held book holder shown in FIG. 1.
FIG. 5 is a cross sectional view of FIG. 4 taken along the line 5—5 showing the rod member extended in an upward position and pressure clamp in a rotational position.
FIG. 6 is a top right end view partially broken away of the handle of the book holder shown in FIG. 1.
FIG. 7 is a cross sectional view of FIG. 4 taken along the line 7—7.

An elongated rod or wire 21 is detachably anchored at one end of the trough in a slot 22 formed in end member 19 and extends along and above the length of the trough to handle 17 where it is anchored and bent over on itself and positioned around a peg 23, as shown in FIGS. 5 and 6. The free end 24 of wire 21 serving as a spring is arranged for engaging a leg 25 of a pivotally mounted arm means 26 that supports laterally thereof at one end a pressure plate 27 of clamp 18 which plate may be formed of a transparent material. Plate 27 is biased counterclockwise by wire 21 to engage one edge of the pages of book 20 which is placed in the trough formed by base member 16 in open book arrangement.

Pressure plate 27 which engages the pages of book 20 is triangular in shape for closely matching the opening formed by the open book configuration in conjunction with the opening formed by trough 16, as shown in FIG. 3A. This arrangement renders it easy to turn the pages of the book when plate 27 is pivotally rotated off of the pages. The base of plate 27 is provided with a protrusion lever to reduce pressure against its biasing means and to rotate the triangular end of plate 27 off of the pages of the book by the thumb of the hand of the user holding book holder 15.

As shown in FIGS. 5–7, the pivotally mounted arm means 26 of clamp 18 comprises a pair of spaced parallelly arranged arms 28, 28' which are each secured to shaft 29 at ends 29' thereof which is rotatably mounted in U-shaped frame 29'' in housing 30 forming a part of the interior of handle 17. The free end 24 of wire 21 biases pressure plate 27 counterclockwise into engagement with the pages of book 20.

Book 20, as shown in FIGS. 2 and 3A, which may comprise a paper back book is placed cover down with its binding extending longitudinally in trough member 16 under wire 21 and pressure plate 27. In order for the reader to place book 20 in the trough, the end 31 of wire 21 must first be removed from slot 22 in end member 19 and lifted upwardly, as shown in FIG. 5, allowing the book to be positioned under wire 21. Wire 21 holds the book securely to book holder 15 after end 31 of wire 21 is placed back into slot 22 of end member 19 and secured therein in a well known manner. For handling and safety reasons, end 31 of wire 21 is turned back on itself into a coil or circular configuration.

In order for the reader to flip pages of book 20 after the book has been installed in trough member 16 and secured under wire 21 as previously mentioned, pressure is applied at the rectangular lever end of plate 27 as shown by the arrow in FIG. 5 providing a clockwise pivotal rotation of plate 27. This pressure to plate 27 may be applied by the thumb of the hand of the user holding the book holder. After pressure is applied to the lever end of plate 27, triangular end of plate 27 completely lifts off the pages of the book allowing the reader to turn the pages of the book using his or her other hand. As the reader peruses forward or backwards from the near middle position of book 20 where securing wire 21 was placed, the pages fold easily over wire 21 without restriction. After a page or pages of the book are turned, the reader releases pressure from the lever end of plate 27, causing it to return to the book to engage its pages holding the reader's place in a selected position of the book 20.

FIGS. 8–12 disclose a further modification of the book holder 15 shown in FIGS. 1–7, wherein book holder 35 comprises a handle 36 supporting a trough 37 which is formed for receiving book 20 therein with a wire 38 extending longitudinally therein in the same manner as shown in FIGS. 1–7 with its end engaging in slot 22 in end plate 19, as shown in FIG. 3B.

The difference in book holder 35 over book holder 15 is in the spring biasing means 39. This spring biasing means comprises a coil spring 40 one end 41 of which is hooked around the right angle bend 42 of wire 38, as shown in FIGS. 11 and 12, and its other end 43 being connected to pressure plate 44 of book holder 35.

Coil spring 40 provides the means for pressure biasing and pivotal rotation counterclockwise of pressure plate 44 to engage and hold a common edge of the open pages of book 20. Circumferential rotation of pressure plate 44 around wire 38, as shown in FIG. 12, compensates for variations in the open plane of book 20 relative to book holder 35 when pages of the book are turned from front to back cover.

Figure 9:
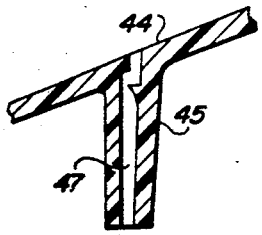
FIG. 9 is a cross sectional view of FIG. 8 taken along the line 9—9.
Figure 12:
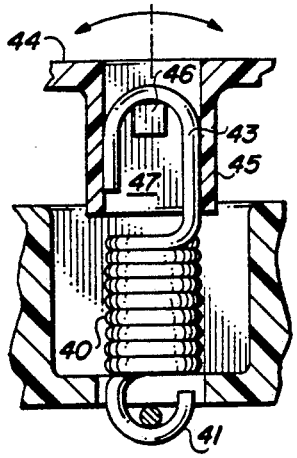
FIG. 12 is a cross sectional view of FIG. 11 taken along the line 12—12.

Pressure plate 44 is provided with a slotted rectangular collar 45 which has a stud 46 extending laterally into slot 47 of collar 45 for receiving therearound the hooked end 43 of spring 40 as shown in FIGS. 9 and 12.

Figure 11:
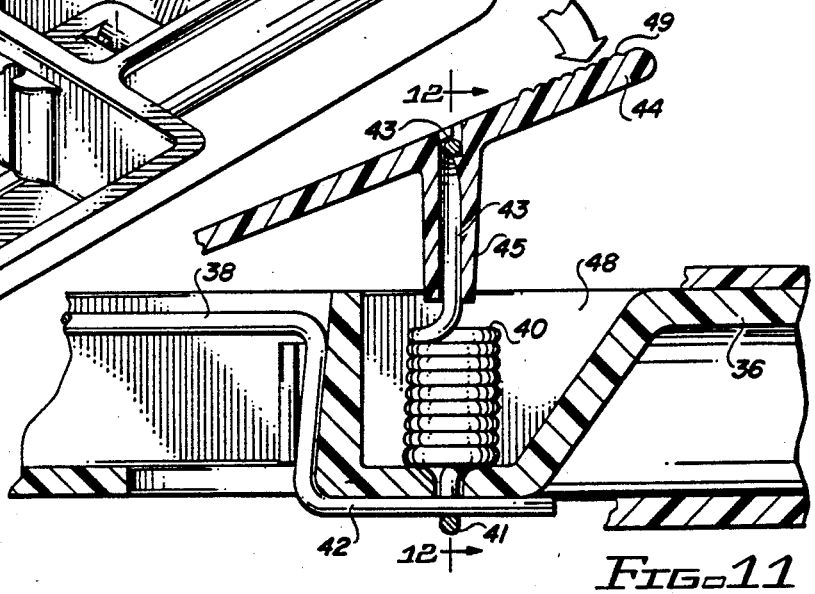
FIG. 11 is a partial view of the spring mounting means shown in FIG. 10 with the spring and rod in place.
Figure 10:
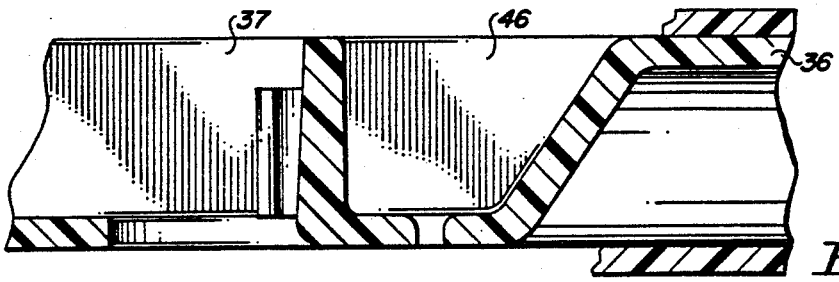
FIG. 10 is a partial cross sectional view of the spring mounting arrangement.
Figure 13:
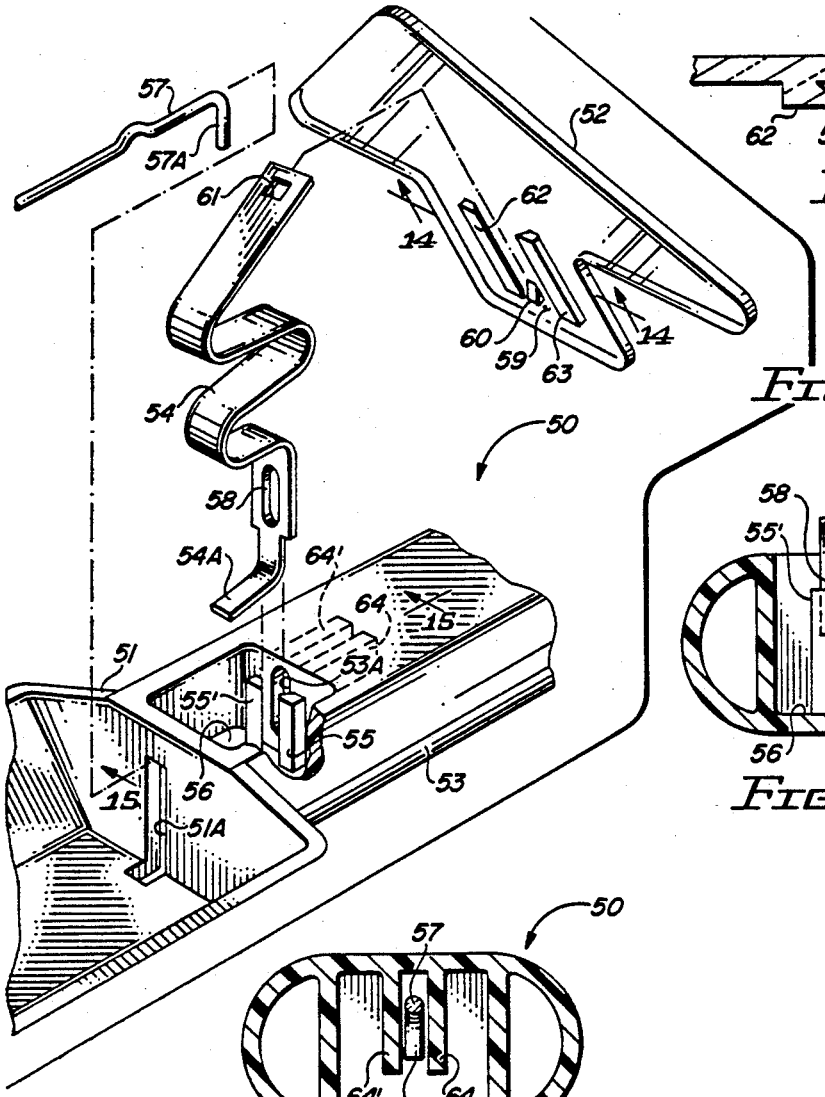
FIG. 13 is a partial exploded view of a further modification of the spring biasing means shown in FIGS. 1-12.
Figure 14:
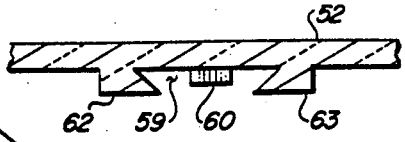
FIG. 14 is a cross sectional view of FIG. 13 taken along the line 14—14.
Figure 17:
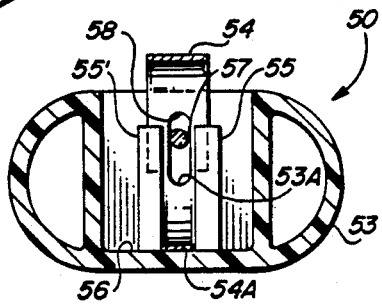
FIG. 17 is a cross sectional view of FIG. 15 taken along the line 17—17.
Figure 16:
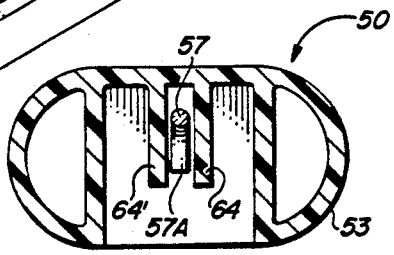
FIG. 16 is a cross sectional view of FIG. 15 taken along the line 16—16.
Figure 18:
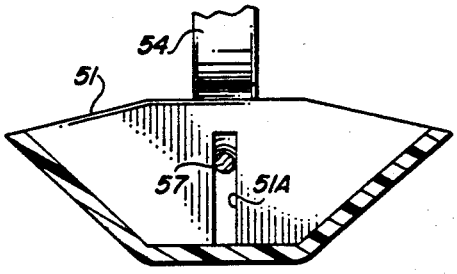
FIG. 18 is a cross sectional view of FIG. 15 taken along the line 18—18.
Figure 15:
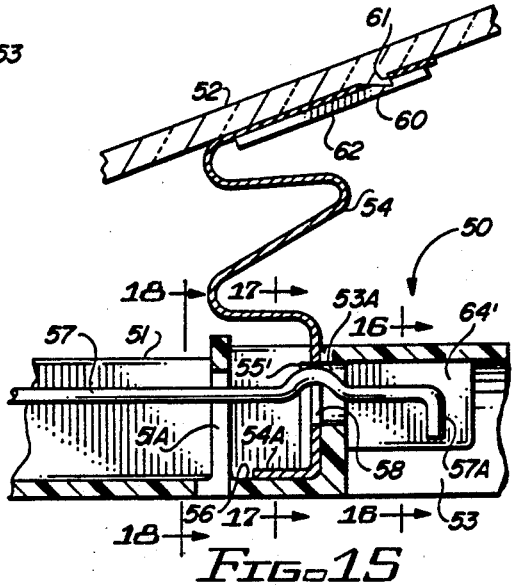
FIG. 15 is an enlarged view of the spring biasing means shown in FIG. 13 in engagement with the pressure plate at one end and the trough at the other end.

As noted from FIG. 11, coil spring 40 is mounted and housed in a well or opening 48 in handle 36 with the curved end 43 fitting tightly in slot 47 of collar 45, thereby maintaining the pressure plate firmly in place and preventing it from rotating axially of the coil spring when in use.

As noted in FIGS. 1 and 11 of the drawings, pressure plates 27 and 44 are each provided with a serrated or similar type of surface treatment on handle 49 for ease in rotating the pressure plate with the user's thumb against its biasing means.

Figure 8:
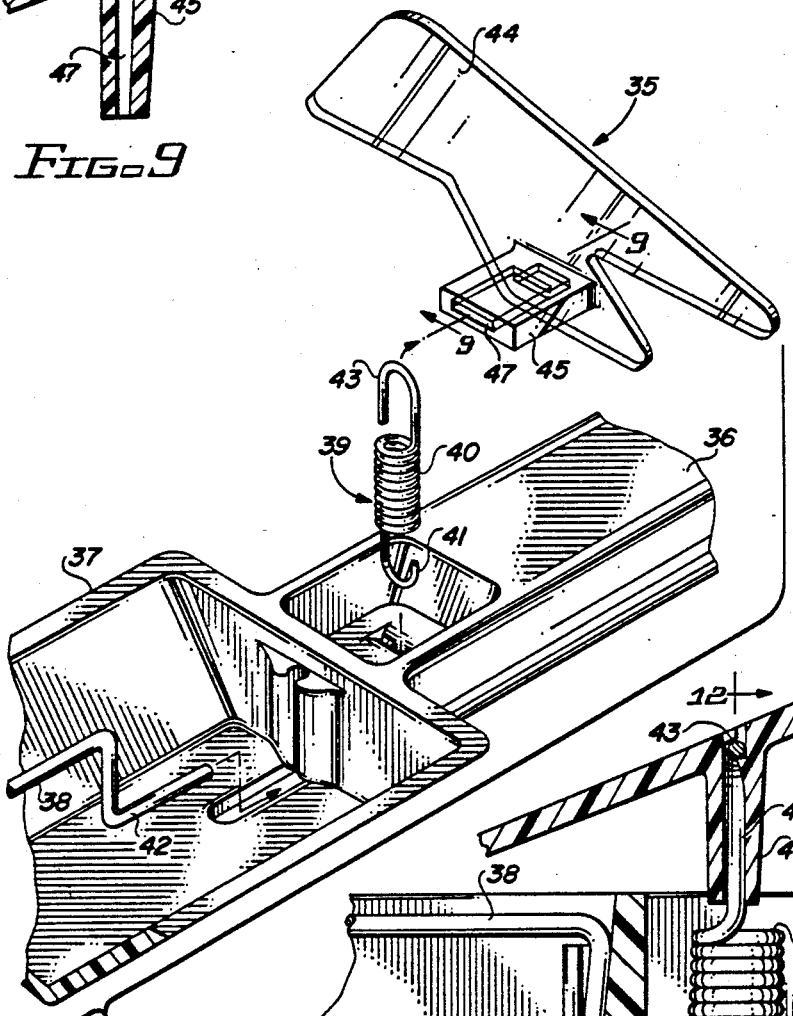
FIG. 8 is a partial perspective view of a modification of the spring biasing means for the pressure plate shown in FIGS. 1 and 4.

Rods 21 and 38 described in FIGS. 1 and 8 may comprise a metallic or non-metallic wire which enables the same to function as described herein.

FIGS. 13–18 disclose a still further modification of the book holders shown in FIGS. 1–12, wherein book holder 50 comprises a trough 51, pressure plate 52 and handle 53 similar to those shown in FIG. 8 wherein the pressure plate 52 is biased by a strap spring 54. End 54A of spring 54 extends laterally therefrom across the bottom of a well 56 in handle 53 and is anchored in spaced supports 55, 55' secured in well 56 of handle 53 by the end 57A of rod 57. End 57A of spring 54 serves as a spring foot for biasing rod 57 upwardly in aperture 58 in spring 54. Rod 57 extends along trough 51 in the manner heretofore described for FIGS. 1–12 through a slot 51A in one end of trough 51 and through an aperture 53A in handle 53 and between supports 64, 64' formed in a hollow recess in handle 53 thereby preventing rotational movement of rod 57. End 57A of rod 57 extends between supports 55, 55' and into handle 53 penetrating into and through an aperture 58 formed in one end of strap spring 54. The other end of strap spring 54 extends into and is locked in place in a slot 59 formed on the bottom side of pressure plate 52 by a pair of rails 62, 63. One way of locking strap spring 54 in place in pressure plate 52 is to provide a protrusion 60 on the bottom of pressure plate 52 which penetrates an aperture 61 in strap spring 54 when that end of the strap spring is inserted in slot 59 formed on the bottom of pressure plate 52 by rails 62 and 63.

Although but a few embodiments have been illustrated and described, it will be apparent to those skilled in the art that various changes and modifications may be made therein without departing from the spirit of the invention of from the scope of the appended claims.

What is claimed is:

1. A hand held book holder comprising:

an elongated frame for supporting a book in an open book position, an elongated handle secured to one end of said frame to extend axially therefrom, a rod extending parallel with and juxtapositioned to said frame to lie over the binding of the associated book when the book is positioned cover down in open book arrangement on said frame, said rod being detachably secured to one end of said frame and anchored to its other end in said handle, and a pressure plate rotatively mounted on said handle for lying over one edge of the open pages of the book supported on said frame, said pressure plate being biased into contact with the pages of the book.

2. The hand held book holder set forth in claim 1 wherein:

said other end of said rod bears against and biases said pressure plate into contact with the pages of the book.

3. The hand held book holder set forth in claim 1 in further combination with:

spring means mounted in said handle for engaging at one end with said other end of said rod and attached at its other end to said pressure plate for biasing said pressure plate into contact with the pages of the associated book.

4. The hand held book holder set forth in claim 3 wherein:

said one end of said spring means biases said rod in contact with the associated book along its binding.

5. The hand held book holder set forth in claim 3 wherein:

said spring means comprises a coil spring means.

6. The hand held book holder set forth in claim 3 wherein:

said spring means comprise a flat spring.

7. The hand held book holder set forth in claim 1 wherein:

said frame comprises a shallow trough like member.

8. The hand held book holder set forth in claim 1 wherein:

said pressure plate comprises a handle extending laterally thereof for rotating said pressure plate away from the pages of the book.

9. The hand held book holder set forth in claim 1 wherein:

said pressure plate comprises a flat triangular member arranged with one apex of said triangle extending laterally across one edge of the pages of an associated open book.

10. The hand held book holder set forth in claim 1 wherein:

said pressure plate is formed of a transparent material.

* * * * *